US007086825B2

(12) United States Patent
Wang et al.

(10) Patent No.: US 7,086,825 B2
(45) Date of Patent: Aug. 8, 2006

(54) FAN

(75) Inventors: Yu Wang, Avon, IN (US); Peter R. Bushnell, Cazenovia, NY (US); Xavier Girod, Montluel (FR)

(73) Assignee: Carrier Corporation, Syracuse, NY (US)

( * ) Notice: Subject to any disclaimer, the term of this patent is extended or adjusted under 35 U.S.C. 154(b) by 109 days.

(21) Appl. No.: 10/949,925

(22) Filed: Sep. 24, 2004

(65) Prior Publication Data

US 2006/0067820 A1 Mar. 30, 2006

(51) Int. Cl.
*F04D 29/38* (2006.01)

(52) U.S. Cl. ..... 415/58.7; 415/173.6; 415/228; 416/189

(58) Field of Classification Search ..... 415/173.6, 415/171.1, 220, 58.7, 58.5, 58.6, 58.3, 58.4, 415/228; 416/189
See application file for complete search history.

(56) References Cited

U.S. PATENT DOCUMENTS

| | | | | |
|---|---|---|---|---|
| 4,357,914 | A | 11/1982 | Hauser | |
| 4,548,548 | A | 10/1985 | Gray, III | |
| 4,685,513 | A | 8/1987 | Longhouse et al. | |
| 4,836,148 | A * | 6/1989 | Savage et al. | 415/170.1 |
| 5,342,167 | A | 8/1994 | Rosseau | |
| 5,489,186 | A | 2/1996 | Yapp et al. | |
| 5,755,557 | A | 5/1998 | Alizadeh | |

* cited by examiner

*Primary Examiner*—Edward K. Look
*Assistant Examiner*—Richard A. Edgar
(74) *Attorney, Agent, or Firm*—Bachman & LaPointe, P.C.

(57) ABSTRACT

A fan is provided for use with a casing having a bellmouth and a conduit portion. The fan has a hub, a number of blades extending from the hub, and a shroud. In cooperation with the casing and the conduit portion surrounding the shroud, the shroud has means for generating a separation bubble effective to limit a recirculation flow.

20 Claims, 8 Drawing Sheets

FAN

BACKGROUND OF THE INVENTION

The invention relates to heating ventilation and air conditioning (HVAC) systems. More particularly, the invention relates to axial flow rotating shroud fans for such systems.

Fans are ubiquitous in HVAC systems. Many fan configurations exist. One group of fan configurations is axial flow rotating shroud or banded fans. These fans include a circumferential shroud at outboard ends of the blades. The blades and shroud of many such fans are unitarily molded of plastic to provide lightness and ease of manufacturing. Such fans are often situated closely downstream of a heat exchanger to draw an air flow across the exchanger (e.g. an air-cooled condenser).

A variety of efficiency concerns attend the design of fans and the associated environment (e.g., housings or casings). One area of efficiency loss results from the recirculation of air near the blade tips. The presence of the shroud may somewhat address this recirculation. Nevertheless, many additional mechanisms have been proposed to further reduce recirculation. For example, U.S. Pat. No. 5,489,186 shows one such proposal.

SUMMARY OF THE INVENTION

One aspect of the invention involves a fan having a hub and a number of blades extending from the hub. A shroud is unitarily formed with the blades and has first and second rims and inboard and outboard surfaces extending between the first and second rims. Along a portion of the shroud proximate the second rim, the outboard surface is radially inwardly convergent toward the second rim along a longitudinal span effective to generate a separation bubble to limit a recirculation flow.

In various implementations, the longitudinal span may be at least 3 mm. The first rim may have a first diameter and the second rim may have a second diameter greater than the first diameter. First and second such fans may be stacked with the first rim of the first fan received concentrically within a portion of the shroud of the second fan. The fan may be combined with a casing including a first portion having a rim having a third diameter less than the first diameter and a second portion at least partially surrounding the shroud. The casing first portion may be a bellmouth of essentially outward longitudinal concavity. The second portion may be a stack extending beyond the bellmouth. The fan may be oriented so that the shroud first rim faces upward. The stack may have a distal end beyond the shroud first rim. The casing first portion may be partially within the shroud. The outer surface of a portion of the shroud proximate the second rim may be radially inwardly convergent toward the second rim along a longitudinal span of at least 3 mm. A cross-sectional median of the portion of the shroud may be similarly convergent along such longitudinal span. The hub may carry a central metallic element having a central longitudinal aperture and a lateral surface. The hub may be unitarily formed with the blades and the shroud. The hub may be formed as an open cup having a sidewall and a base. The hub may further comprise a central boss for engaging a shaft mounting insert and a number of substantially radially-extending ribs extending from the boss to the sidewall and along the base and having rims. For each of the blades there may be a single associated one of the ribs aligned with the root of such blade. The hub may further include, for each of the ribs, a longitudinally and transversely-extending post formed in an outboard portion of the associated rib. Each post may have a cross-section characterized by a flat central web and first and second terminal protuberances. Inboard of the associated post, each of the substantially radially-extending rib rims generally increases in longitudinal position from inboard to outboard. Outboard of the associated post, each of the substantially radially-extending rib rims is of generally constant longitudinal position from inboard to outboard. The fan may further include a polymeric cover secured at an open end of the hub. The fan may be combined with a motor having a shaft having a portion coupled to the hub against rotation and a stator coupled to the shaft so as to drive the fan.

Another aspect of the invention involves a fan system having a motor. A fan is driven by the motor and has a hub, a number of blades extending from the hub, and a shroud. A casing has a conduit at least partially surrounding the shroud. Means are on the casing and shroud for creating a separation bubble between the casing and the shroud effective to limit a recirculation flow. The casing may have a downstream rim beyond a downstream rim of the shroud. The shroud may have a downstream rim portion with an outer diameter less than an outer diameter of an upstream portion, effective to permit a number of identical fans to be stacked in a partially nested configuration when off-motor.

Another aspect of the invention involves a fan having a hub, a number of blades extending from the hub, and a shroud. In cooperation with a casing having a bellmouth and having a conduit at least partially surrounding the shroud, the shroud has means for generating a separation bubble effective to limit a recirculation flow.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
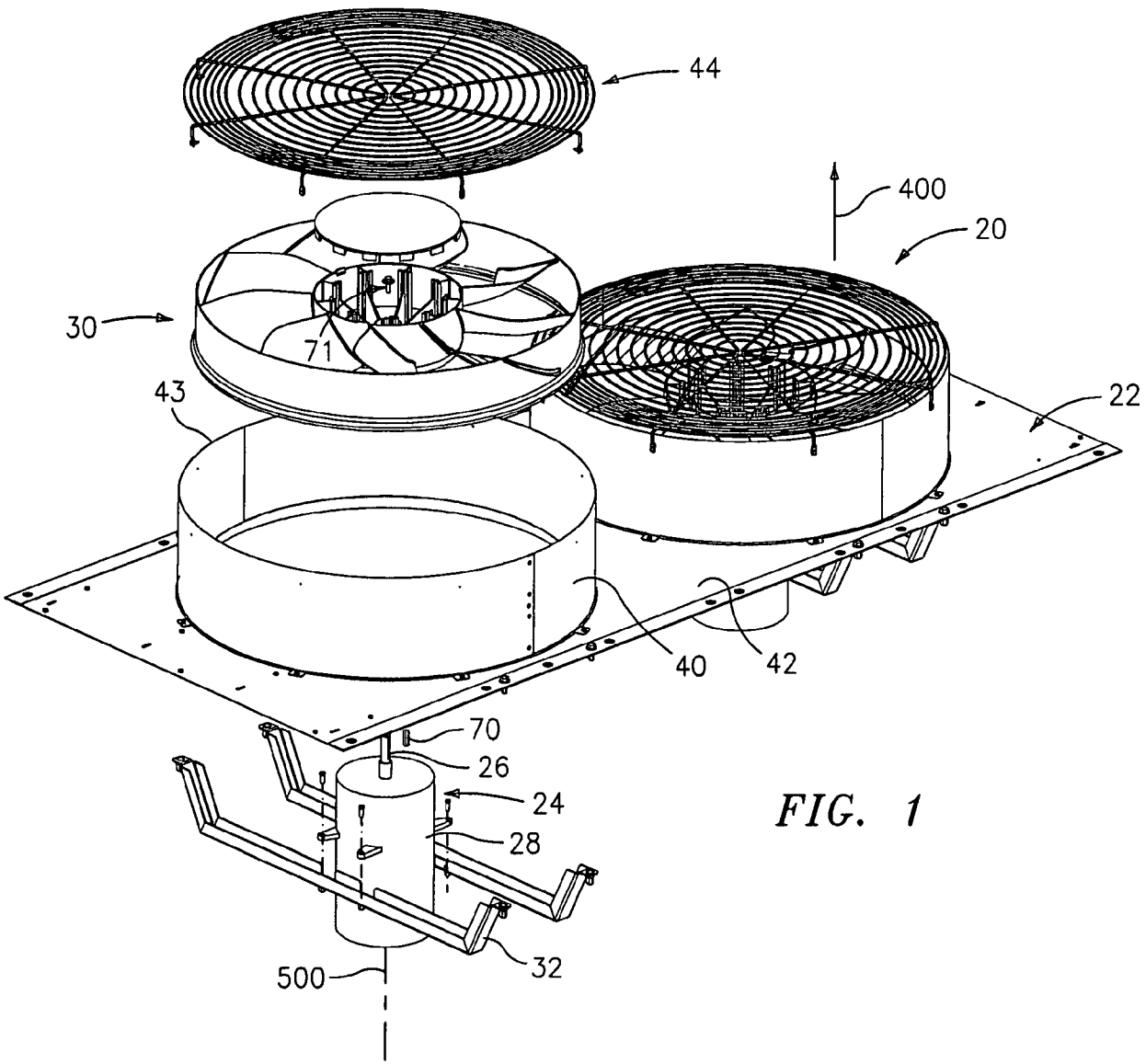
FIG. 1 is a partially exploded view of a pair of electric fan units.

FIG. 1 shows a pair of electric fan units 20 mounted from a casing component 22 of an HVAC system. Each fan unit includes an electric motor 24 having a shaft 26 with a portion protruding from the housing or case 28 containing a stator (not shown). In operation, the motor shaft is driven about a common central longitudinal axis 500 of the fan unit to drive an air flow 400 in a downstream direction along a flowpath (e.g., from a condenser (not shown) directly below/upstream). The fan unit further includes a fan (impeller/rotor) assembly 30 mounted to the protruding portion of the shaft.

In the exemplary embodiment, each fan unit 20 is mounted to the casing assembly by a pair of mounting brackets 32. In the exemplary embodiment, each fan assembly 30 is concentrically mounted within an annular cylindrical casing conduit segment shown as a stack 40 extending from a proximal end at a flat casing wall 42 to a distal end (e.g., a downstream rim 43) carrying a grille 44. Other configurations are possible.

Figure 2:
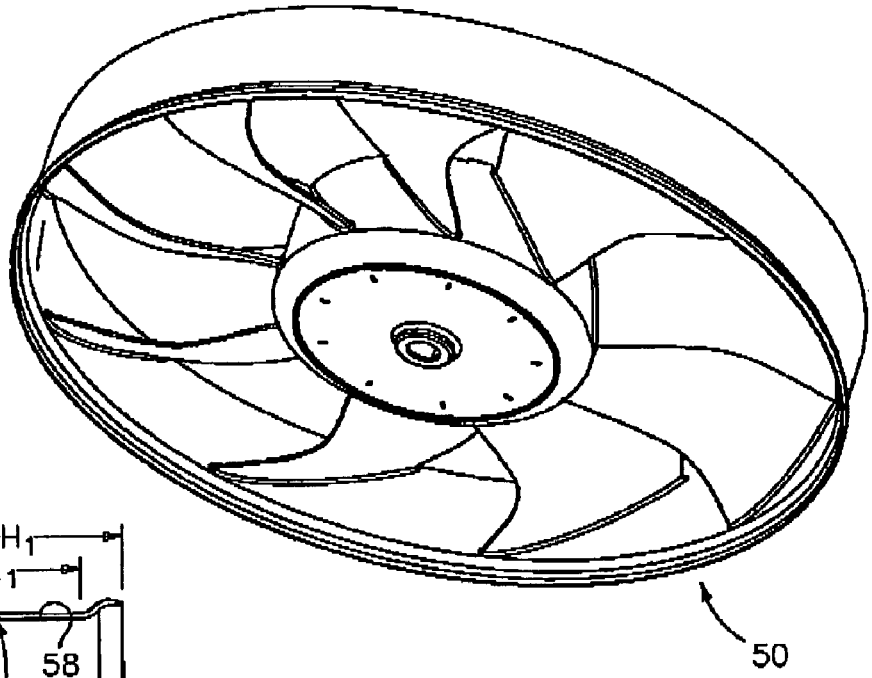
FIG. 2 is a view of a fan assembly of one of the units of FIG. 1.
Figure 3:
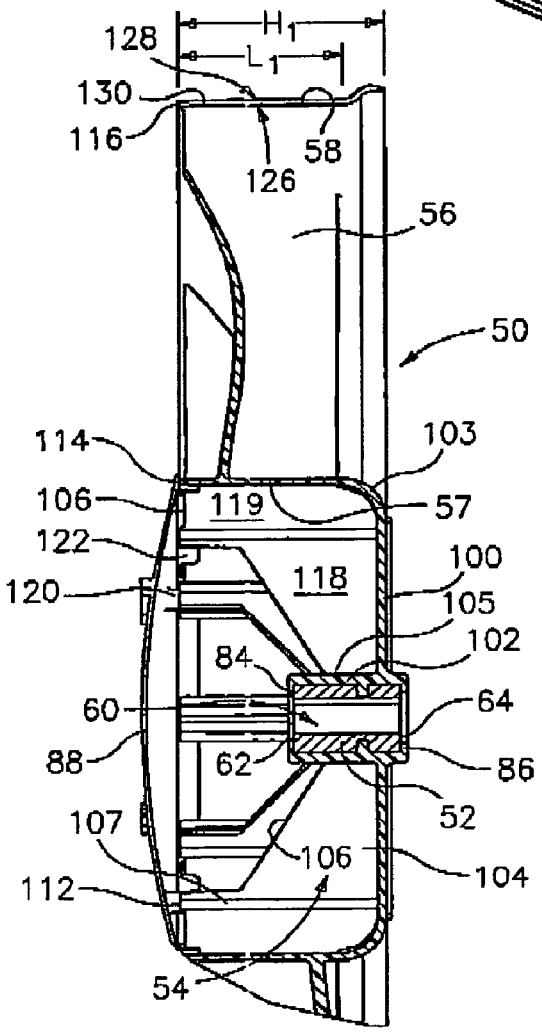
FIG. 3 is a partial longitudinal sectional view of the fan assembly of FIG. 2.
Figure 4:
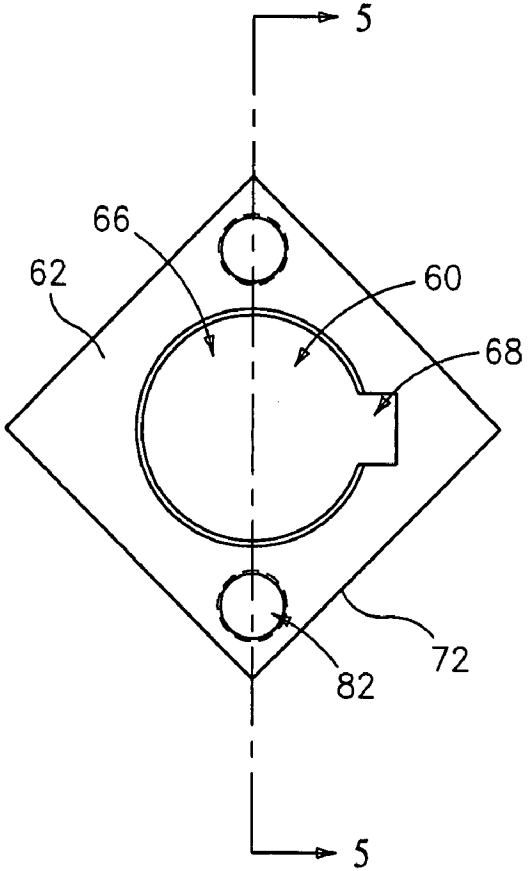
FIG. 4 is a front end view of an insert of the fan assembly of FIG. 2.

FIGS. 2 and 3 show further details of the exemplary fan assembly 30. The fan assembly 30 includes the combination of a unitarily-formed molded plastic component 50 (FIG. 2) and a metallic insert 52 (FIG. 3). The metallic insert is at least partially embedded in a hub portion 54 of the molded component. Blades 56 radiate outward from inboard root ends at a sidewall 57 of the hub. The molded component further includes an annular shroud 58 at the blade outboard ends. The metallic insert includes a central longitudinal aperture 60 for receiving the protruding end of the motor shaft. The exemplary central aperture 60 extends between first and second end surfaces 62 and 64 of the metallic insert and consists essentially of a right circular cylindrical bore 66 (FIG. 4) coaxial with the fan axis and a slot-like keyway 68 extending radially outward from at least a portion of the bore. The keyway receives a portion of a key 70 (FIG. 1) of which a second portion is similarly received in a keyway in the shaft to lock the metallic insert to the shaft against relative rotation. A screw, bolt, or similar fastener 71 (FIG. 1) may have a threaded shaft extending into a threaded aperture in the motor shaft and a head bearing against (e.g., via a washer) the front surface 62 to prevent unintended longitudinal ejection of the fan.

Figure 5:
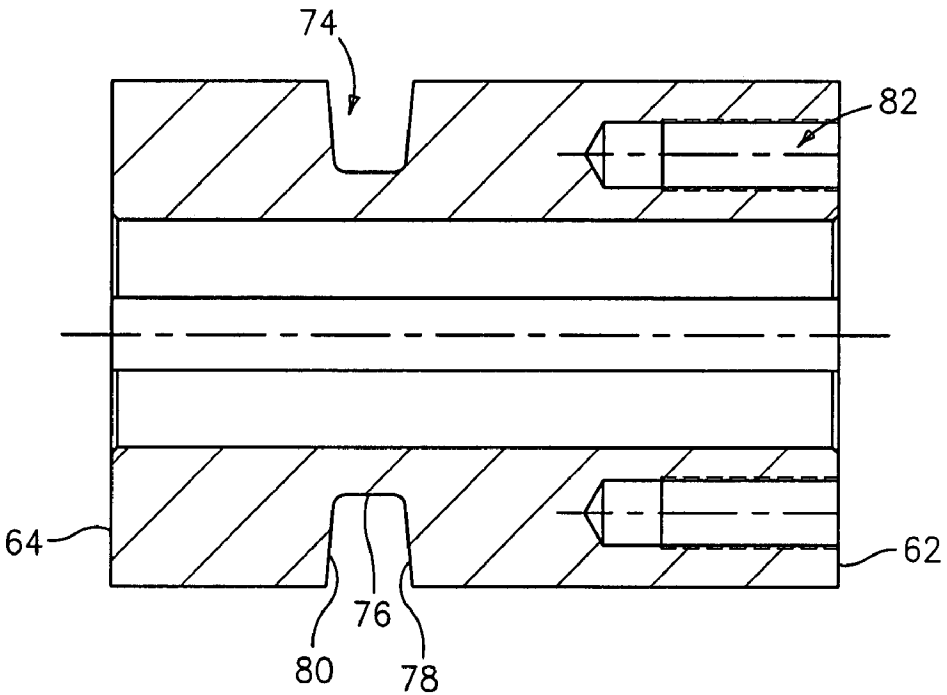
FIG. 5 is a longitudinal sectional view of the insert of FIG. 4, taken along line 5—5.

The metallic insert 52 has a lateral surface characterized by four facets 72 (FIG. 4) defining a square cross-section. The square cross-section may correspond to bar stock (e.g., brass) from which the insert is cut. In the exemplary embodiment, to improve longitudinal engagement between the insert and the molded component, there may be one or more recesses 74 (FIG. 5) in the lateral surface. An exemplary recess comprises a near-right annular channel having a circular cylindrical base 76 and a pair of near-radial sidewalls 78 and 80 with slightly radiused transitions. Additionally, the exemplary embodiment includes a pair of blind threaded bores 82 extending longitudinally inward from the front surface 62. The bores 82 are off-center and aid in fan extraction from the motor/shaft as is discussed in further detail below.

In an exemplary process of manufacture, insert precursors are cut from square-section bar stock. The cutting (which may include one or more stages such as rough cutting and surface milling) essentially defines the end surfaces and the principal portion of the lateral surface. The cut precursor may be fixtured (e.g., in a lathe or similar tool) and the central bore 66 drilled and the channel 74 cut. The precursor may then be refixtured for milling the keyway 68 and again refixtured for drilling and tapping the bores 82.

After the insert has been formed, it may be registered in a portion of a die (not shown) for molding the molded component 50. The die may be assembled and plastic (e.g., glass-reinforced polypropylene) injected to form the molded component. The exemplary molding nearly entirely embeds the insert within the hub. In the exemplary embodiment, webs 84 and 86 (FIG. 3) of the molded material extend along outboard portions of the insert ends 62 and 64, having apertures therein to expose the channel at both ends and bores at the end 62. The apertures advantageously extend sufficiently radially beyond the channel to permit engagement of the fastener 71 to the end 62 (e.g., by accommodating a washer) and engagement of a shoulder on the motor shaft with the upstream end 64 so as to longitudinally clamp the insert (e.g., via direct compressive contact). With the motor preinstalled in the appropriate environmental structure, the combination of the molded component and insert may be installed to the shaft (e.g., by sliding the insert over the shaft 26 and key 70 and installing the fastener 71 and/or by press/interference fitting). Thereafter, a cover (e.g., also molded plastic such as unreinforced polypropylene) 88 (FIG. 3) may be placed over the hub (e.g., via snap fit within a perimeter of the hub).

Figure 6:
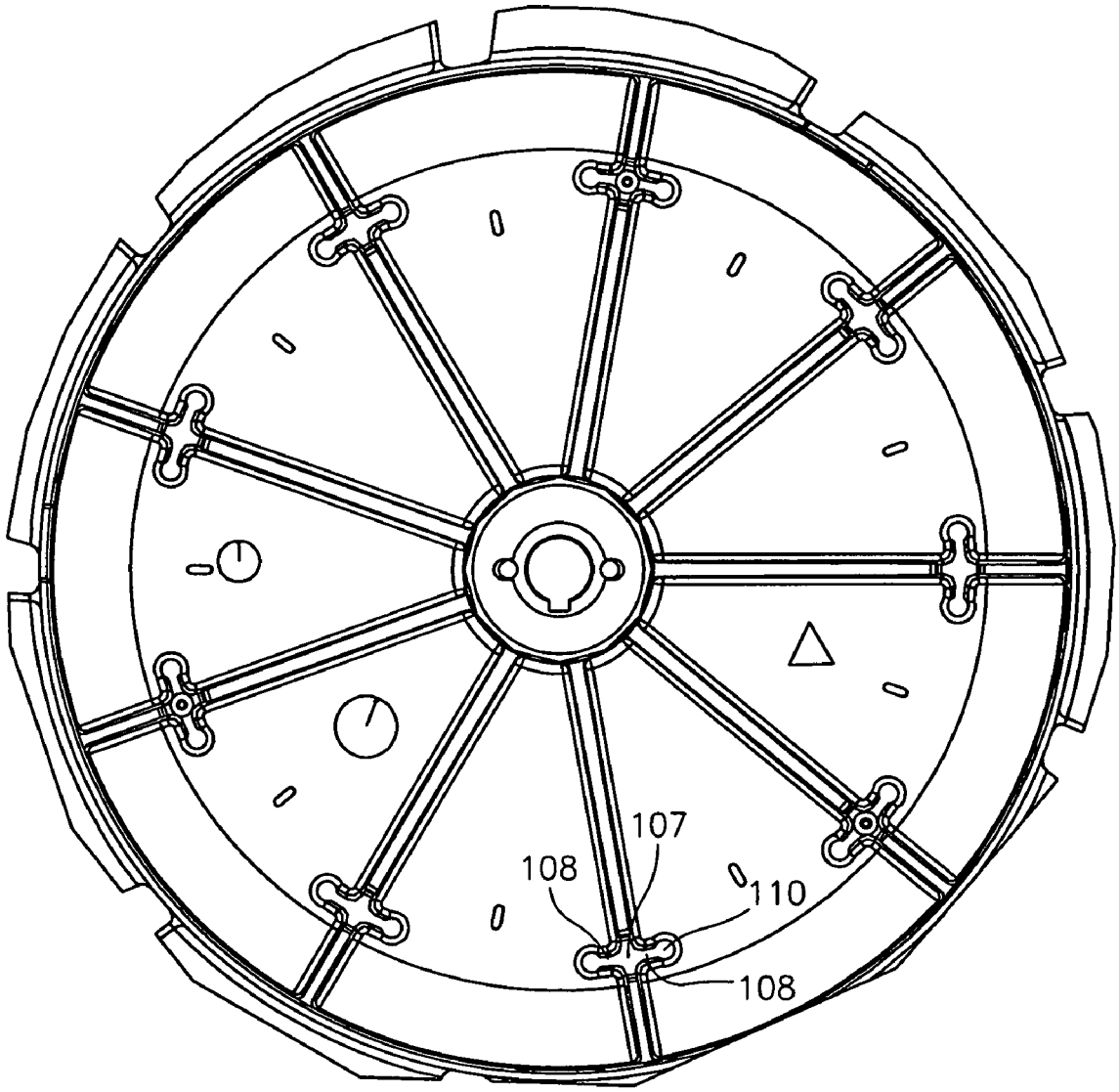
FIG. 6 is a view of a hub of the fan assembly of FIG. 2.

Further details of the fan hub 54 are shown in FIG. 3. The hub includes a base wall 100 extending radially outward from a central boss 102 accommodating the insert 52. In the exemplary embodiment, the base wall 100 is near an upstream end of the boss, with an upstream end portion of the boss including the web 86 protruding slightly upstream of the upstream surface of the base wall. The base wall has a rounded transition shoulder 103 with/to the sidewall 57. A circumferential array of web-like radially-extending ribs 104 extend from proximal roots at the outer surface or periphery 105 of the boss 102 to distal ends at the sidewall 57. Each rib 104 has a downstream end surface 106 diverging from the root outward. In a relatively outboard location (e.g., at about ⅔ of the radial span of the ribs 104) each rib has a post portion 107. The post portions 107 have a pair of circumferentially/transversely extending portions 108 (FIG. 6) having rounded circumferential end protuberances 110. In the exemplary embodiment, downstream post surfaces 112 (FIG. 3) are substantially flush to a downstream rim 114 of the sidewall 57 and a downstream rim 116 of the shroud 58. The posts 107 divide the associated ribs 104 into inboard and outboard portions 118 and 119, respectively. Along the outboard portion 119 the end 106 is just slightly recessed relative to the rims 114 and 116. The end 106 is more substantially recessed along a major portion of a radial span of the inboard rib portion 118. In the exemplary embodiment, the posts provide gates for the introduction of molding material. The post downstream surfaces 112 maybe engaged by mold-ejection pins to eject the molded component from the mold. The surfaces 112 also provide abutment surfaces for associated feet 120 of the cover 88. Cover tabs 122 engage the inner surface of a downstream portion of the sidewall 57 in a snap fit/detent relation.

Figure 7:
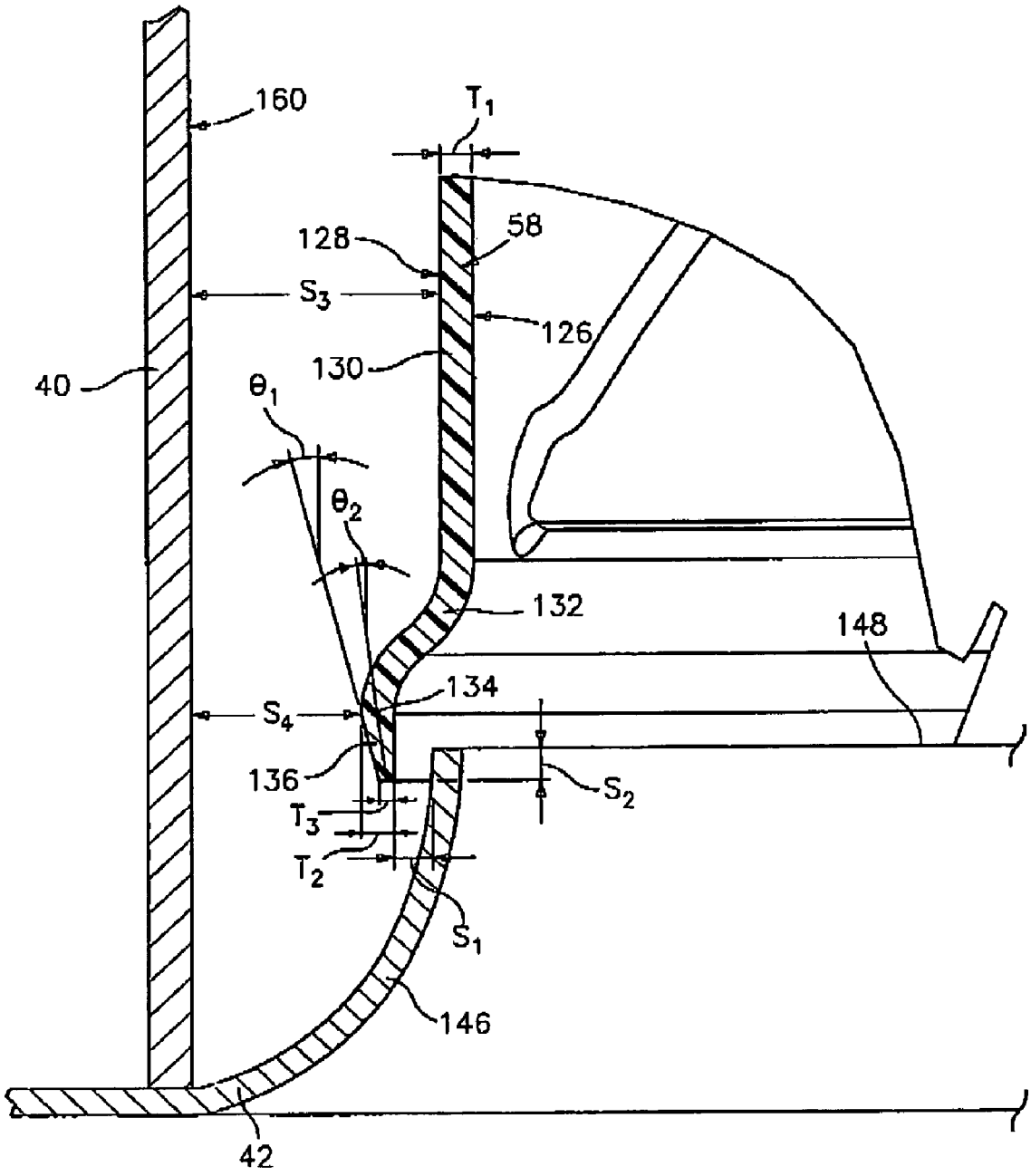
FIG. 7 is a longitudinal sectional view of an upstream portion of a shroud of the fan assembly of FIG. 2.

FIGS. 3 and 7 show further details of the shroud 58. The shroud 58 has generally inboard and outboard surfaces 126 and 128 (FIG. 3). The shroud 58 has a substantially longitudinally extending first portion 130 extending upstream from the rim 116 (FIG. 3) for a length $L_1$ which may be a major portion (e.g., 80–90%) of a shroud height $H_1$. The shroud then has an outwardly flaring portion 132 (FIG. 7) transitioning from outwardly concave to outwardly convex and extending essentially to a maximum radius location 134. Extending upstream therefrom is a tapering portion 136 along which the inboard surface is substantially longitudinal and the outboard surface is inwardly-convergent at a half angle $\theta_1$. Exemplary $\theta_1$ values are 5–30°, more narrowly 12–25°. A sectional median is convergent at a half angle $\theta_2$. Exemplary $\theta_2$ values are 3–15°, more narrowly 6–12°.

Extending outward/downstream from the flat wall 42 of the casing 22 is a bellmouth 146. The exemplary bellmouth 146 is radial outwardly concave and downstream convergent to near longitudinal at a downstream rim 148. The bellmouth is partially concentrically received within the upstream portion 136 with an exemplary radial separation $S_1$ and an exemplary longitudinal overlap $S_2$. Exemplary $S_2$ is 0–10 mm. An exemplary separation between the shroud outboard surface 128 and stack inboard surface 160 is shown as a constant $S_3$ along the shroud lint portion 130 and a minimum value $S_4$ at the shroud maximum radius location 134.

Figure 8:
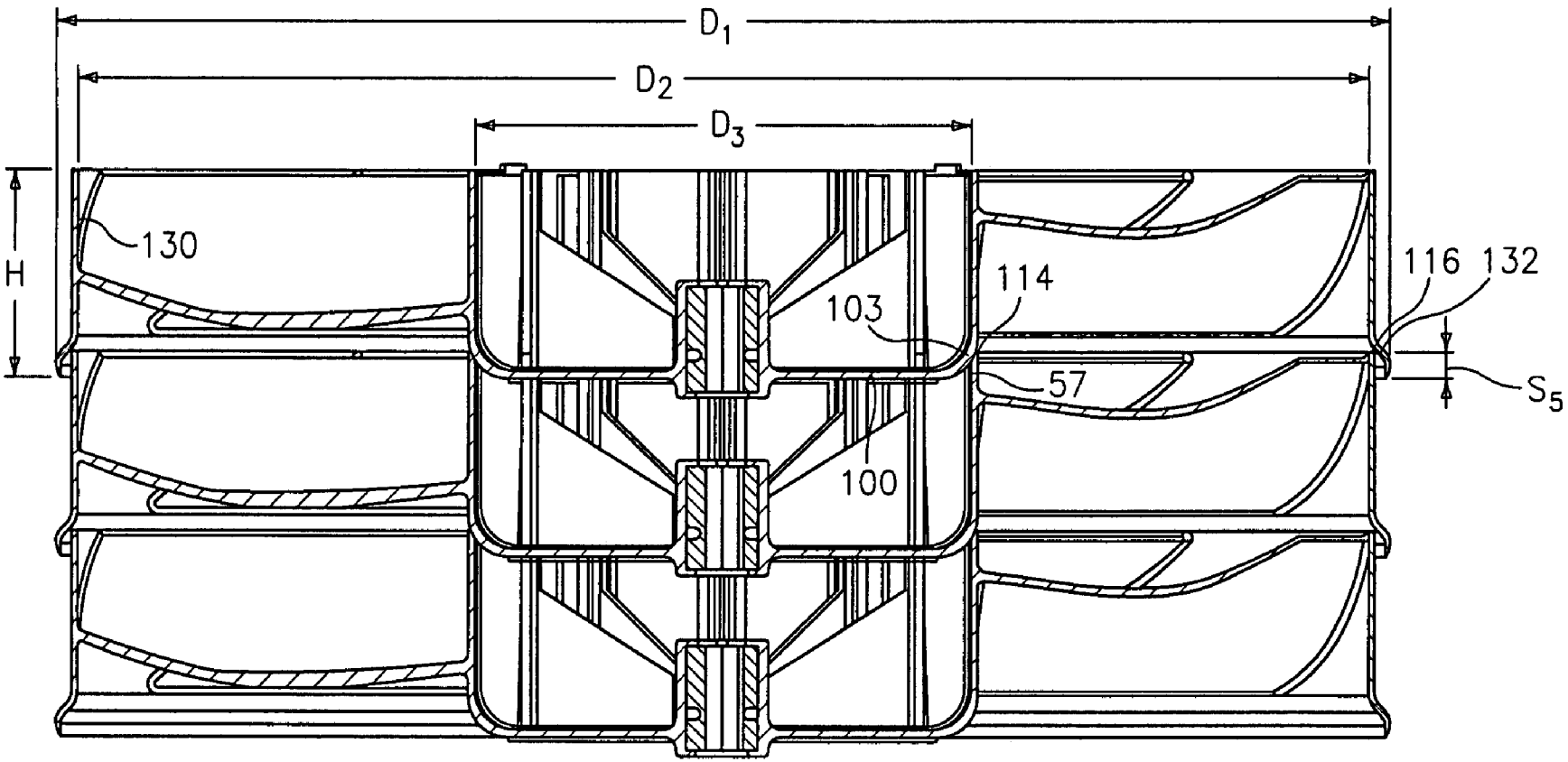
FIG. 8 is a longitudinal sectional view of stacked fan assemblies.

FIG. 8 shows how the fan assemblies can be stacked for shipping. In the stacking, a downstream portion of the shroud 58 of a first of the two stacked fans is telescopically received within an upstream portion of the shroud of a second fan. The hub base 100 of the second fan is concentrically received within a downstream portion of the hub sidewall 57 of the first fan. The dimensions may advantageously be such that there is contact both between: an inboard portion of the hub rim 114 of the first fan and an exterior surface of the hub shoulder 103 of the second fan; and an exterior portion of the shroud rim 116 of the first fan and the shroud interior surface along the outwardly flaring portion 132 of the second fan. This double engagement (which may be present under unloaded conditions or under very slightly loaded conditions (e.g., weight loading of an exemplary 2–10 stacked fans)) may provide exceptional stability and damage resistance for transportation of stacked fans. In stacking, an exemplary overlap $S_5$ may be an exemplary 10–15% of H. FIG. 8 further shows the fan as having an exemplary maximum exterior diameter $D_1$. Exemplary $D_1$ values are 0.5–1.0 m. Exemplary heights H are 0.08–0.15 m. An exemplary hub internal diameter $D_3$ at its downstream rim 114 is 0.25–0.35 m. An exemplary characteristic (e.g., mean or median) thickness $T_1$ along the portion 130 may be 2–4 mm. An exemplary thickness $T_2$ at the location 134 may be similar. An exemplary thickness $T_3$ at the upstream rim (or very close thereto) (e.g., within 0.5 mm or 11.0 mm) may be equal to or less than half of $T_2$ (e.g., 1.0–2.0 mm). The convergence may occur over a longitudinal span (e.g., between the location 134 and the upstream rim) in excess of 150% of $T_2$.

Figure 9:
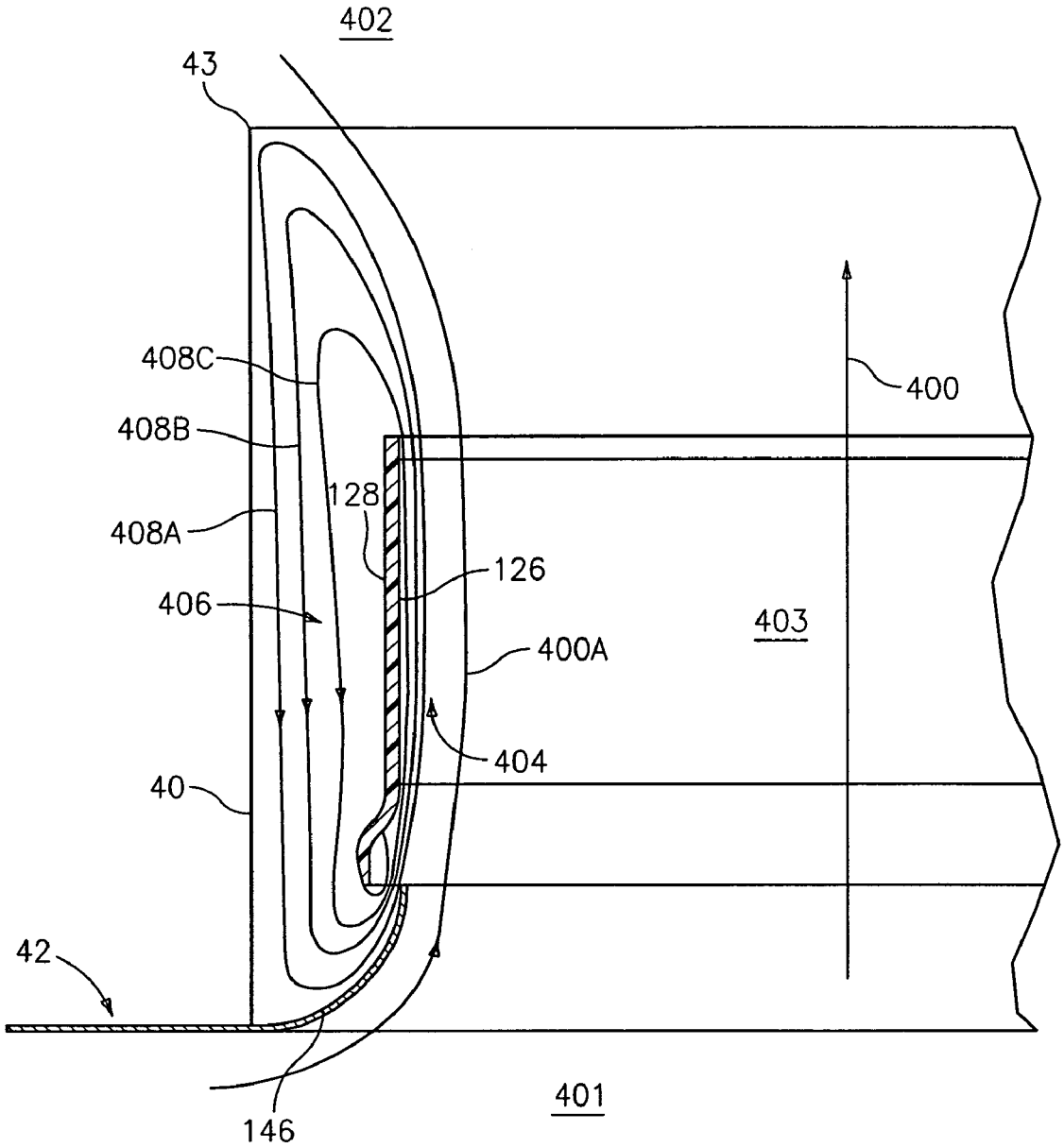
FIG. 9 is a partial longitudinal flow diagram of air flow through the fan assembly of FIG. 2.
Figure 10:
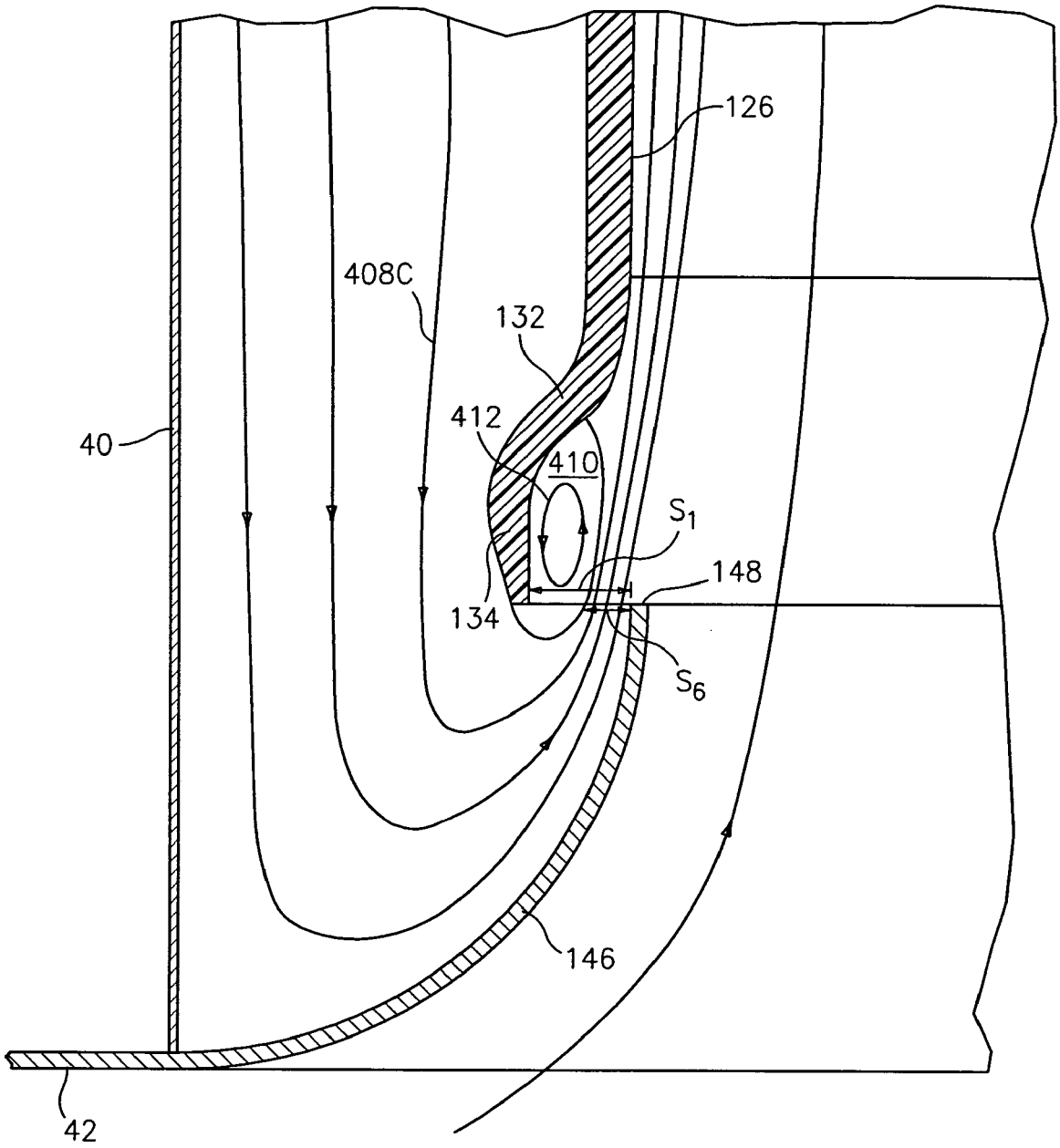
FIG. 10 is an enlarged view of an upstream portion of the flow diagram of FIG. 9.

FIG. 9 schematically shows the flow 400 forming from the casing interior 401 upstream of the bellmouth 146 downstream to an exterior 402. This flow is through a central annular region 403 of the shroud. This flow may be characterized by a plurality of annular flow lines (lines when viewed in section) of which a single line 400A is shown. Through an annular outboard shroud region 404, between the inboard region 403 and the shroud inboard surface 126, is a recirculating flow passing back down through a region 406 between the shroud outboard surface 128 and the stack inboard surface. This recirculating flow is illustrated by a number of exemplary flow lines 408A, 408B, and 408C. The innermost of these flow lines 408C is seen passing essentially along the shroud inboard surface. The presence of the outwardly flaring and inwardly tapering portions 132 and 134 helps create an annular separation region/bubble 410 (FIG. 10) between the recirculating flow and the adjacent portion of the inboard surface 126. Within this separation region, there may be a recirculating flow characterized by flow lines 412. The effect of this separation bubble is that for a given physical radial spacing $S_1$ there may be a much smaller radial sectional span $S_6$ (and thus sectional area) for the main recirculating flow to pass. It is desirable to avoid collision between the shroud and bellmouth due to vibration, air disturbance, foreign object impact, and the like. This argues in favor of a large spacing (e.g., $S_1$ for the illustrated embodiment). However, minimizing loss due to the main recirculating flow argues against a large spacing. The presence of a separation bubble 410 thus helps achieve the anti-interference benefits of a large spacing with the efficiency benefits of a small spacing.

One or more embodiments of the present invention have been described. Nevertheless, it will be understood that various modifications may be made without departing from the spirit and scope of the invention. For example, when implemented as a reengineering or remanufacturing of an existing electric fan, details of the existing fan may influence details of any particular implementation. Accordingly, other embodiments are within the scope of the following claims.

What is claimed is:

1. A fan comprising:

a hub;

a plurality of blades extending from the hub; and a shroud unitarily formed with the blades and having:

a first rim;

a second rim;

inboard and outboard surfaces extending between the first and second rims, wherein:

along a portion of the shroud proximate the second rim, the outboard surface is radially inwardly convergent toward the second rim along a longitudinal span effective to generate a separation bubble to limit a recirculation flow.

2. The fan of claim 1 wherein:

the longitudinal span is at least 3 mm.

3. The fan of claim 1 wherein:

the first rim has a first diameter; and the second rim has a second diameter greater than the first diameter.

4. First and second fans of claim 3 stacked with the first rim of the first fan received concentrically within portion of the shroud of the second fan.

5. The fan of claim 1 in combination with a casing including:

a first portion having a first rim having a third diameter, less than the first diameter; and a second portion, at least partially surrounding the shroud.

6. The combination of claim 5 wherein:

the first portion is a bellmouth of essentially outward longitudinal concavity; and the second portion is a stack, extending beyond the bellmouth.

7. The combination of claim 6 wherein:

the shroud first rim faces upward; and the stack has a distal end beyond the shroud first rim.

8. The combination of claim 5 wherein:

the casing first portion is partially within the shroud.

9. The fan of claim 1 wherein a cross-sectional median of a portion of the shroud proximate the second rim is radially inwardly convergent toward the second rim along a longitudinal span of at least 3 mm.

10. The fan of claim 1 wherein the hub is unitarily formed with the blades and the shroud.

11. The fan of claim 1 wherein the hub is formed as an open cup having a sidewall and a base.

12. The fan of claim 11 wherein the hub further comprises:

a central boss for engaging a shaft mounting insert; and a plurality of substantially radially-extending ribs extending from the boss to the sidewall and along the base and having rims.

13. The fan of claim 12 wherein:

for each of the blades, there is a single associated one of the ribs aligned with a root such blade.

14. The fan of claim 12 wherein the hub further comprises:

for each of the ribs, a longitudinally and transversely-extending post formed in an outboard portion of the associated rib.

15. The fan of claim 14 wherein:

each post has a cross section characterized by a flat central web and first and second terminal protuberances;

inboard of the associated post, each of the substantially radially-extending rib rims generally increases in longitudinal position from inboard to outboard; and outboard of the associated post, each of the substantially radially-extending rib rims is of generally constant longitudinal position from inboard to outboard.

16. The fan of claim 1 further comprising a polymeric cover secured at an open end of the hub.

17. The fan of claim 1 in combination with an electric motor driving the fan.

18. A fan system having:

a motor, a fan according to claim 1 driven by the motor; and a casing having a conduit at least partially surrounding the shroud.

19. The fan system of claim 18 wherein:

the casing has a distal rim downstream of a downstream rim of the shroud.

20. The fan system of claim 18 wherein:

the shroud inboard and outboard surfaces are dimensioned effective to permit a plurality of identical fans to be stacked in a partially nested configuration when off-motor.

* * * * *